United States Patent [19]

Westerlund

[11] 4,326,941

[45] Apr. 27, 1982

[54] ELECTROLYTIC CELL

[75] Inventor: Sture Westerlund, Sundsvall, Sweden

[73] Assignee: KemaNord AB, Stockholm, Sweden

[21] Appl. No.: 162,258

[22] Filed: Jun. 23, 1980

[30] Foreign Application Priority Data

Jun. 27, 1979 [SE] Sweden ..... 7905619

[51] Int. Cl.[3] ..... C25B 9/00

[52] U.S. Cl. ..... 204/268; 204/269; 204/270

[58] Field of Search ..... 204/95, 254–258, 204/268–270, 275–278, 288

[56] References Cited

U.S. PATENT DOCUMENTS

| | | | |
|---|---|---|---|
| 3,732,153 | 5/1973 | Harke et al. | 204/269 X |
| 3,759,815 | 9/1973 | Larsson | 204/268 |
| 3,824,172 | 7/1974 | Hodges | 204/270 X |
| 3,992,279 | 11/1976 | Larsson | 204/268 X |
| 4,088,551 | 5/1978 | Raetzch et al. | 204/270 X |
| 4,101,406 | 7/1978 | Westerlund | 204/268 X |

*Primary Examiner*—Delbert E. Gantz
*Assistant Examiner*—Donald R. Valentine
*Attorney, Agent, or Firm*—Fred Philpitt

[57] ABSTRACT

Electrolytic cell for the production of alkali metal or alkaline earth metal chlorate from the corresponding chlorides, which cell is constructed from a plurality of cells (10) connected in series, whereby all electrodes (11, 19) except the terminal electrodes (19) are bipolar and designed with a vertical base plate (14), having one side functioning as anode in one cell unit (10) and the other side functioning as cathode in an adjacent cell unit (10) and whereby the exterior sides of the terminal electrodes (19) have electrical connections for the cell row while the sides turned inwards and both sides of the base plates (14) on the other electrodes (11) have a number of vertical electrode plates (17, 18), fitted essentially at right angles to the base plates (14), and whereby the base plates are positioned in such a manner that the electrode plates (17, 18) of adjacent base plates (14) are interleaved between each other, without direct electrical contact between themselves, forming an electrode package of electrode plates. A housing (1) encloses the cell row so that spaces for electrolyte flow are formed below, at the sides of and above the electrode packages, whereby the space above these is larger than the others and forms a flow space in which the essential part of the disproportionation reaction of the chlorate can take place.

10 Claims, 5 Drawing Figures

ELECTROLYTIC CELL

TECHNICAL FIELD

The present invention relates to an electrolytic cell construction and more particularly to an electrolytic cell construction for the production of alkali metal or alkaline earth metal chlorate by electrolysis of alkali metal or alkaline earth metal chloride.

BACKGROUND OF THE INVENTION

Bipolar electrode constructions are used to an ever increasing extent in order to obtain compact, efficient and economical electrolysis units and by bipolar electrode constructions are understood such electrodes which have one face functioning as an anode in one cell unit and the other face functioning as a cathode in an adjacent cell unit. By positioning a number of such units in a row, a battery of cells connected in series is obtained, which only requires current supply connections at the end electrodes but no special electrical connections between each cell unit. An especially advantageous electrode construction for these purposes, when a large electrode surface is desired, consists of a base plate provided with electrode plates fixed essentially at right angles to the base plate. This type of construction gives, besides a large electrode surface, a low voltage drop per running meter of the cell box which reduces risks of current leakage and short-circuit, both in the cell and outside it. The base plate can be provided with electrodes on one side only (unipolar embodiment) while means for current supply are provided on the other side. This arrangement does not only give the advantage that the base plates can form one wall of the cell, but also means that the base plates are available for a very simple connection to the current supply connections. The base plates can also be provided with electrode plates on both sides (bipolar embodiment) and the electrode plates on one side will then form cathodes while those on the other side will form anodes. By positioning a number of such electrode units in a row, with the electrode plates of adjacent electrodes between each other, a battery of cells connected in series will be obtained, after adding side walls, bottom and cover, and in this only the terminal electrode units have to be of the unipolar type and be provided with means for current supply on one side of the base plates instead of with electrode plates. This arrangement gives a very simple design of the cell row and also eliminates requirements on special current connections between the cells.

When employing the principles for bipolar electrodes at electrolytic production of chlorate, certain problems specific to this process will, however, arise. The chlorate production comprises a number of sub-steps and the sequence of reactions is probably a first formation of hydroxyl ions at the cathode during hydrogen generation and of elementary chlorine at the cathode, whereafter the hydroxyl ions and chlorine react to hypochlorite ions, which finally are disproportionated to chlorate and chloride. A number of requisites have to be fulfilled if this course of reaction is to take place at optimum conditions. The electrolyte flow past the electrode surfaces must be rather high and the production of hypochlorite at each circulation of the electrolyte past the electrodes must be moderate in order to avoid side reactions and other negative effects. The electrolyte circulation must further permit an efficient removal of formed hydrogen gas, and formed chlorine gas must be efficiently absorbed and retained in the electrolyte during the entire course of reaction. The electrolyte must be given a sufficient residence time after the electrolysis to give a complete reaction, particularly for the disproportionation of hypochlorite to chlorate. These conditions are seldom fulfilled in known bipolar electrode constructions of the above discussed type, as these generally are designed to be as compact as possible and to give the highest possible current density which often has resulted in an optimum relation between the volume and the residence time, but not in a carefully considered circulation flow of the electrolyte.

Other problems are caused by the corrosive environment in the cell. This environment is dependent partly on the composition of the electrolyte and partly on the high temperatures which are normally kept in order to achieve a high reaction rate. Corrosion problems lead to a limited service life for essentially all parts of the cell and necessitates a regular servicing of the cell. The cell should consequently be easy to dismount and it should be easy to replace and to clean its parts. As the electrodes themselves in cells with bipolar electrodes form partition walls problems of sealing these against the walls of the cell box will also arise, both with respect to electrolyte leakage and current leakage between the cells, and the sealings must be made with arrangements which are safe from the corrosion aspect and which do not make it much more difficult to disassemble the cell.

Known constructions do only to a limited extent possess the mentioned properties. Bipolar systems have thus been designed either with external reaction vessels and forced circulation, or they have had a complicated internal construction which has not been very suitable with respect to corrosion and maintenance.

THE INVENTION GENERALLY

The primary object of the present invention is to provide an improved and simplified cell construction, for electrolytical chlorate production, of the kind that comprises bipolar electrodes, a construction which is especially improved with respect to electrolyte circulation, corrosion resistance at higher temperatures and accessability for repairs and servicing.

This object is accomplished by a cell designed according to the claims.

The cell of the invention is thus of the kind which is built up from a plurality of cells connected in series, whereby all the electrodes except the terminal ones are bipolar and provided with a vertical base plate, one side of which functions as an anode in one cell unit and the other side functions as a cathode in an adjacent cell unit. The exterior sides of the terminal electrodes are equipped with electrical connections for the cell row while the sides turned inwards and the two sides of the other base plates have a number of vertical electrode plates, fitted essentially at right angles to the base plates, and the base plates are positioned in such a manner that the electrode plates of adjacent base plates are interleaved between each other, without direct electrical contact between themselves, forming an electrode package of electrode plates. With this arrangement, which is known per se, a high current density can be applied to each cell and at the same time a large flow area for vertical flow of electrolyte past the electrodes is obtained, which is essential in order to obtain the above mentioned rapid circulation.

According to the invention the cell row is enclosed in a housing of such dimensions that a space is formed between the bottom of the housing and the lower edges of the electrode plates, a space is formed between the vertical sides of the housing which are parallel to the electrode plates and the nearest electrode plates and a space is formed between the upper sides of the electrode plates and the top of the housing. The last mentioned space is larger than those below and at the sides of the electrode plates, and form an extra flow and reaction space for the electrolyte. Further intermediate partitions are arranged between the cell unit in form of extensions of the base plates downwards, towards the sides and upwards limiting a space for each cell unit. It is preferred that vertical walls which direct the flow are arranged parallel to the electrode plates, the walls extending from the upper side of the outermost electrode plates in the cell unit up in the space above the cell package.

By this arrangement a flow channel for the electrolyte circulating in the cell is formed. The electrolyte flows past the electrode plates, is enriched with hydrogen gas, rises upwards between the side walls and the flow directing walls, when such walls are present above the electrode package, turns at the top of the channel where hydrogen gas is concentrated, flows downwards along the walls of the housing and finally turns at the bottom and anew flows up between the electrode plates. The flow is essentially stable during the entire circulation and substantially free from back-mixing which gives a maximum reaction rate for the chlorate formation. A substantial height of liquid is obtained above the electrode plates which gives a great lifting effect and circulation rate and a good absorption of chlorine gas and at the same time a sufficient residence time for the electrolyte during the circulation is obtained. The width of the circulation channels and the position of the electrode plates give a low flow resistance. The enclosed electrolyte volume leads to a stable and easily controlled operation with only minor variations of the operation parameters.

According to a particularly preferred embodiment the partition walls or the base plates are mutually connected with special connecting means, separate from the housing, and the partition walls are designed to have essentially the same shape as the cross section of the housing and have sealings along the edges in contact with the housing. This means that the housing can be designed without special means for fixing and with a smooth inner side which facilitates renovation and repairs. The electrodes can be lifted out of the housing as a unit or be disassembled on the spot. Few parts of a simple design diminish the corrosion problems. If the housing, as well as other parts parallel to the electrode plates, are made from plastic material while the partition walls are made from titanium, a construction which is very resistant to corrosion and safe with respect both to internal and external short-circuits and current leakage is obtained.

DETAILED DESCRIPTION OF THE INVENTION

Known materials for chlorate cells can be used in the bipolar electrodes. It is, however, preferred that the base plate comprises a titanium plate which advantageously can be joined to another plate on the side which functions as a cathode. This other plate can be an iron plate and can be joined to the titanium plate by means of explosive joining or other methods for intimate joining. For base plates with several layers of this kind, the titanium plate is preferably shaped in such a manner that the partition walls can be connected and sealed thereto and this is most simply done by making the titanium plate extend somewhat beyond the iron plate around the circumference of the base plate. Electrode plates are fixed to the base plate at essentially right angles thereto and they are suitably fixed by means of welding and soldering. The height and the length of the electrode plates can very e.g. between 0.1 and 1 meter, but are preferably between 0.2 and 0.5 m. The material of the electrode plates can on the cathode side be iron and on the anode side be noble oxide or titanium covered with such. The electrode plates on the anode side and the cathode side respectively are suitably somewhat displaced with respect to each other in order that a straight cell row is obtained when several electrodes are assembled and the cathode electrode plates are positioned between the anode electrode plates. In normal cases there is one more anode plate than the number of cathode plates, so that the electrode package after assembly will be terminated by anode plates on both sides for the protection of the nearest cathode plates. Electrode plates of different polarities should not be in touch with each other so that electrical contact is established, but should be kept separated and preferably have a well defined and, between the different parts of electrode, constant distance from each other. The thickness of the electrode plates can be between 0.5 and 10 mm and is preferably between 1.5 and 4 mm. The free gap between the assembled electrode plates is preferably also within these range limits, but does not have to be the same as the thickness of the electrode plates. Spacers can be arranged between the electrode plates but should not occupy more than a fraction of the space between the electrode plates in order that the vertical flow of the electrolyte should not be hindered. The number of cells connected in series is suitably between 3 and 15 for one row and preferably between 6 and 12. A number of 8 cells has been found to give a manageable cell row unit. The terminal electrodes have of course, as has been mentioned above, only electrode plates on the sides turned inwards to the cell while current supply means advantageously can be arranged on the outer surface. The base plates, which suitably are un-perforated, form at least a part of the walls between the cells connected in series. After the electrodes have been assembled in the above discussed manner, an electrode package is thus formed from the electrode plates. The vertical sides of the package are made up from the outermost electrode plates and from the base plates and the horizontal sides are formed form the upper and lower edges of the electrode plates. The last mentioned edges do consequently not form impermeable surfaces but permit vertical flow of the electrolyte. An electrode row constructed in this manner is not self-supporting but for formation of a continuous unit and for maintaining dimensional accuracy between the electrodes special connecting means are necessary.

A cell housing, containing the electrolyte, is arranged around the electrodes connected in series in the electrode package. This housing shall not enclose the electrode packages tightly, but shall leave sufficient space around the electrode packages so that a controlled circulation flow can be obtained. The plane of the circulation flow is parallel to the base plate of the electrodes. The housing is common to the entire row of cells connected in series. The electrode packages can then be placed at one of the long sides of the housing so that the upwards flow of the electrolyte takes place on this side and the downwards flow on the opposite long side, but it is preferred that the cell package is placed in a central position in the housing, in order that the flow upwards be central while the flow downwards takes place along both the long sides. In order to get the most satisfactory circulation flow, the area for flow upwards should approximately correspond to that for the flow downwards, which means that the total free distance from the cell package to the two long sides should be between 0.75 and 1.25 times the horizontal width of the cell package at right angles to the long sides, and the total distance is preferably between 0.8 and 1.15 times the width of the cell package. The downcoming electrolyte flow turns at the bottom of the housing and flows horizontally in towards and below the cell package through which it then anew percolates vertically. The distance between the lower edge of the cell package and the bottom of the housing should also, for this reason, be so great that it corresponds to the flow area for the downwards flowing electrolyte. For a central positioning of the cell package the distance to the bottom should thus be between 0.2 and 0.8 times the width of the cell package and preferably between 0.3 and 0.6 times this width. If the cell package is positioned at the side of the cell housing, the distance to the bottom should be between 0.3 and 1.0 and preferably between 0.4 and 0.8 times the horizontal width of the cell package. The housing should be designed in such a manner that there is a greater space for vertical electrolyte flow above the cell packages than the space below the cell package. The purpose of this space is to produce the driving force in the circulation flow by taking advantage of the hydrogen gas lift, and if a powerful circulation is to be achieved the space must not be given a too small height. Another purpose of this space is to give, together with other circulation spaces, a sufficient residence time for the electrolyte for a sufficient conversion of hypochlorite to chlorate before the electrolyte anew passes in between the electrodes. An important object of the cell construction of the invention is to give the electrolyte most of the required residence time for conversion, and preferably substantially the entire residence time, within the housing, in order to avoid additional external reaction vessels to the greatest extent. The volume of the housing must then not be too small but neither so big that it gives rise to constructional problems. A suitable electrolyte level above the electrode packages is thus between 5 and 15 times the height of the electrode packages and preferably between 7 and 13 times this height. It is advantageous, from several points of view, that the entire housing is filled with electrolyte so that no larger gas volumes are formed. This means that electrolyte containing finely dispersed hydrogen gas is led from the housing and to a gas separation step, apart from the volume of the housing. The outlet for the electrolyte can advantageously be arranged at the top of the housing. The height of the cell box in absolute dimensions will thus suitably be between 2 and 5 m or preferably between 3 and 4 m. The housing should be divided into a bottom part and a cover part, which can be separated from each other, but which during operation are tightly connected with each other, e.g. by horizontal flanges following around the vessel. The dividing line is suitably somewhat above the cell package in the bottom part to give a good accessability to this when the cover is removed.

The selection of material for the housing as well as for the electrodes is of great importance with respect to corrosion resistance and thereby to the possibilities of keeping high electrolyte temperatures which reduces the necessary reaction volume. The material of the housing is suitably a body with an interior corrosion resistant coating. The body can be of metal, but it is preferred that it is made from synthetic material as this reduces corrosion problems and risks of short-circuits and gives a lighter construction. Among synthetic materials glass fibre reinforced polyester, optionally containing embedded metal reinforcements is preferred. The inner side should be coated with a corrosion resistant material which can be metallic, e.g. made of titanium, but in that case electric insulation is required between each step. A synthetic material which has a good resistance to the electrolyte is thus to prefer. Suitable such materials are plastics containing fluor, such as polytetrafluoroethylene, polyfluoroethylenpropylene and polyvinylidene fluoride. It has particularly been found that such plastic coated on fabric works well and the fabric has then been made from fibres of synthetic materials, particularly glass fibres. The coating, as well as repairs, are facilitated and the durability is increased if the inner sides of the vessel, both its bottom and cover, are made essentially smooth without particular fixing means or other devices for partition walls, which is possible if the partition walls are arranged in the manner described below.

The spaces which are arranged to make the circulation flow of the electrolyte around the electrode package possible, means that special partition walls must be arranged on a level with the base plates of the electrodes and extend from these, out towards the housing, beneath and at the side and up above the electrode packages. The partition walls are necessary in order to prevent a too large mixing of the electrolyte between the cells and to prevent current leakage. They are also necessary to maintain the controlled circulation flow so that a stable and substantially tubular flow is obtained. The requirement on effecient sealing is at its greatest near the electrodes, where even minor current leakages can cause important efficiency losses. The problems decrease with the distance from the electrodes owing to the increasing resistance in the electrolyte. Although it is possible to enlarge the base plate of the electrodes so that it will form a partition wall outside the part which is covered with electrode plates, this method is not suitable for economical reasons and from a practical point of view. The cell is thus, according to the invention, preferably equipped with separate partition walls which fill substantially all of the cross-section of the housing which is parallel to the base plate, at least at the bottom and the greater part of the height of the housing. It is not necessary that the partition walls reach right up to the top of the housing, but a free mixing space for the electrolyte immediately beneath the upper surface of the cover can be allowed without risks of current leakages. The partition wall is provided with a notch in its lower part to give a tight fitting of the base plate of the electrode. It is suitable to divide the partition wall in a lower part, having a design substantially corresponding to the cross-section of the lower part of the housing, and an upper part, having a design substantially corresponding to the cross-section of the cover of the housing. If the partition wall is divided in this manner the dividing line suitably goes through the notch for the base plate so that the electrode can be inserted or taken out when the upper part of the partition wall has been removed. The lower part of the partition wall should be of such dimensions that it can carry the load of the bipolar electrode inserted therein as well as the load of the upper part of the partition wall. It is then suitable to provide the lower edge of the partition wall with a footing or something similar to give a lenient finish towards the covering of the housing and it is preferred to provide also the side-edges of the partition wall with such finishes. In order that the base plate will be able to carry a load it must be possible to insert it in the notch of the partition wall in a stable manner. A suitable way to get a connection between these parts which is easily demounted is to provide the base plate or preferably the vertical sides of the partition wall in the notch with U-shaped finishes so that the base plate of the bipolar electrode can be inserted from above downwards to the bottom. The upper horizontal edge of the base plate, or preferably the corresponding edge or edges on the upper partition wall can in a similar manner be provided with a U-shaped finish so that the upper part of the partition wall can be placed on the lower part and on the base plate, fixing the upper wall in position with respect to these parts. The partition walls can be made from a material which is resistant to the electrolyte and non-conductive, e.g. from a plastic material. As the partition walls are parallel to the base plates and at right angles to the potential drop in the row of cell compartments connected in series they get an iso-potential position and can thus also be made from metal, which is preferred, at least for the lower partition wall. A preferred metal is titanium which has both good strength proprerties and good corrosion resistance.

As there is no contact between the electrode plates of adjacent bipolar electrodes, other than through optional spacers between them, a self-supporting electrode row is not obtained from merely electrodes and partition walls but the distance between the different partition walls and electrodes must first be fixed by other means. Such means are suitably arranged between the partition walls instead of between the electrodes. One way of fixing the partition walls in a mutual relation and with a well-defined and stable distance and with good parallelism between the base plates and thereby between the electrode plates is to arrange rods along the cell row and to fix these to each partition wall. A plurality of such rods should then be arranged and fixed to each partition wall. The rods are fixed in such a manner that the relative distance between the partition walls is fixed, e.g. by means of spacers on the rods. The rods are suitably made from a non-metallic material such as from one of the above mentioned synthetic materials, e.g. polytetrafluoroethylene. It is most important, and often sufficient, that the lower part of the partition walls are provided with this kind of means for fixing as these parts, as has been said above, carry the greatest load and furthermore defines the electrode distances. With such means the electrodes and the partition walls form a continuous and separate unit which can be totally self-supporting. Such a unit can be placed in the housing without special fixing means in this and function there without additional sealing means.

According to a preferred embodiment of the invention the space for the electrolyte flowing upwards is separated from that flowing downwards by arrangement of a flow-tube in the space above the electrode packages. The flow-tube is arranged vertically and has an opening at its lower part which collects all the electrolyte coming up from the electrode package, and brings it up to the desired height in the housing where it is allowed to turn and flow downwards. The tube can have many different shapes, it can e.g. have a flow-regulating neck at the middle or have special gas-separating means at the top. In order to obtain a good circulation flow it has, however, been found that it is sufficient that the rising flow is separated from the one going downwards by means of a smooth flow-controlling wall which is arranged vertically and at right angles to the partition walls and which extends between these above the outer edges of the electrode package, in such a way that the flow-controlling walls together with the partition walls form the tube for the rising liquid. As the flow-controlling walls thus extend between the partition walls they can also serve as spacers between these and fixing means for them. If the flow-controlling walls are provided with fixing means at their vertical edges and the partition walls are provided with corresponding fixing means vertically above the outer contour of the electrode package and these means are joined, a continuous structure is obtained from these walls and this structure does not require special fixing means in the cover of the housing for obtaining a stable fixing.

Supply pipes for the electrolyte can be arranged in the form of longitudinal pipes in the cell and these pipes can be placed in notches in the partition walls. If these notches are at the dividing line between the lower and the upper part of the partition walls the pipes can be inserted and removed when the upper and lower parts of the partition walls have been separated. The pipes are connected to feed pipes outside of the cell via inlets in the housing. If the electrolyte between the cell spaces can be mixed within the housing, e.g. in a space at the top of the housing as described above, it might suffice to supply the electrolyte to some of the cell spaces only and a longitudinal pipe is then not necessary but simple inlets can be used. At least one opening should be provided in the upper part of the housing for conveying the electrolyte to a special hydrogen-gas separating step and to the chlorate separating step.

A construction designed as described above can be dismounted in the following manner. The cover is loosened and removed. The unit comprising upper partition walls and flow-controlling walls is removed and can if so desired be further disassembled somewhere else. Optional supply pipes and outlet pipes are removed from their notches. The unit of electrodes and lower partition walls is lifted out of the lower part of the housing. The individual electrodes can be removed from the notches in the partition walls. The individual partition walls are separated by removal of the fixing means between them. The electrodes and the lower partition walls can alternatively be disassembled while they are still in the bottom part of the housing. The cell is assembled in inverted order.

In order to get a satisfactory circulation flow in a cell of the above described type the current concentration should be 10 to 40, preferably 18 to 35, amperes per liter circulating electrolyte in each potential drop. A preferred flow rate of 0.05 to 0.7 m/s in the electrode gap and a residence time for the electrolyte of 0.5 to 7 minutes between the passages through the electrode gaps can then be obtained. The temperature should be kept between 50° and 90° C. and preferably between 60° and 80° C. in order that the conversion of hypochlorite to chlorate will be sufficiently rapid. At the exit from the electrode gap the hypochlorite concentration expressed as sodium hypochlorite should be between 0.5 and 5 grams/liter and preferably between 1.5 and 3.5 grams/-liter. The chlorate concentration is between 300 and 700 grams per liter, calculated as sodium chlorate, and the chloride concentration is between 50 and 300 grams per liter, calculated as sodium chloride. The pH of the electrolyte is roughly between 5 and 8 but is preferably between 5.8 and 6.5 and most preferably about 6.1. From the electrolyte a part of the flow is in a known manner conveyed from the cell for separation of hydrogen gas and chlorate and recirculation to the cell.

ACCOMPANYING DRAWINGS

The accompanying drawings show a preferred embodiment of the cell of the invention for electrolytic production of sodium chlorate.

FIG. 1 is a cross-sectional view of the cell along the cell row.

FIG. 2 is a cross-sectional view of the cell at right angles to the cell row.

FIG. 3 is a cross-sectional view of the lower partition wall towards the bottom.

FIG. 4 is a cross-sectional view of the upper partition wall towards the bottom.

FIG. 5 is a horizontal cross-sectional view through the bipolar electrode.

DESCRIPTION OF THE DRAWINGS

As is best shown in FIGS. 1 and 2 the cell housing, with general numeral 1, comprises a bottom part 2 and a cover part 3 which parts can be tightly joined along their respective flanges 4 and 5. The housing has inlets 6 for supply pipes for the electrolyte and for current connections 7. The housing also has an outlet 8 for electrolyte and hydrogen gas. The housing is made from polyester having an inner corrosion resistant coating of polyvinylidene fluoride which is about 3 mm thick. Reinforcing profiles 9 of polyester are arranged on the outer side of the housing, and these may optionally contain metal reinforcements. The housing has a height of 3.6 m, a width of 0.9 m and a length of 3.4 m. The inner portion of the housing is divided into 8 cell compartments 10 by arrangement of partitions comprising bipolar electrodes 11, lower partition walls 12 and upper partition walls 13. The construction of the bipolar electrodes 11 is best shown in FIG. 5. The electrodes comprise a base plate 14 of an anode plate 15 made from titanium and intimately joined to a cathode plate 16 made from iron. Anode electrode plates 17 of titanium covered with noble metal oxide are welded on to the anode plate and cathode electrode plates 18 of iron are welded on to the cathode plate 16. The anode electrode plates 17 and the cathode electrode plates 18 are somewhat displaced with respect to each other. The total active surface of the electrode plates is about 10 $m^2$ and the plates should stand a current of 25 kA. The cell potential is about 3 volts. Seven bipolar electrodes are arranged in the housing and their base plates 14 are parallel and their anode electrode plates and cathode electrode plates are placed between each other for formation of the cells connected in series. The cell rows are at each end terminated by a unipolar electrode 19 which has electrode plates only on the side facing the inner of the housing and which has means for external current supply feed on the other side. The bipolar electrodes 11 are carried by the lower partition walls 12 and the latter are best shown in FIG. 1 and 3. The lower partition wall 12 is made from a plate of titanium, about 3 mm thick, and is essentially U-shaped. The outer side edges and the bottom edge are provided with footings 20 welded thereto. The lower part of the vertical inner edges of the U-shaped partition wall 12 is provided with U-profiles 21, welded thereon, and intended to grasp the vertical edges of the anode plate 15 when the bipolar electrode 11 is inserted, from above and downwards, into the central notch of the lower partition wall 12. The electrode 11 with then rest on the horizontal edge 22 of the partition wall 12. The notches in the partition wall 12 are somewhat deeper than the height of the base plate of the electrode and a part of the notch will thus remain after the insertion of the electrode. Four holes 23 have been made in the partition wall 12 and rods 24 are brought through these and fixed to the partition walls for keeping the latter together at a desired distance and this is best evident from FIG. 2. The construction of the upper partition wall 13 is shown in FIGS. 1 and 4. The upper partition wall 13 can be made from thinner material than the lower one as it does not have a carrying function and in this embodiment it has a thickness of about 2 mm and is likewise made from titanium. Its upper edge is essentially straight and ends about 0.4 m from the top of the housing. Its lower edge has a shape corresponding to that of the lower partition wall, i.e. it has an extension 25 going down into that part of the notch in the partition wall 12 which is not occupied by the base plate. On the lower part of the extension 25 is welded a U-profile 26 which is intended to grip the upper horizontal part of the anode plate 15. Other parts of the dividing line between the upper partition wall 13 and the lower partition wall 12 are filled with packings 27 of synthetic material and these have an H-profile and join the partition walls to each other. In the partition walls 13 are notches 28 wherein a longitudinal pipe 29 can be placed, which pipe can be connected to an outer pipe 30 via the inlet 6. Electrolyte can then be fed to each cell compartment via inlet pipes 31. The upper partition wall 13 has, as the lower one 12, welded footings 20 at its vertical edges in order to spare the inner covering of the housing. The partition wall 13 is also provided with vertically welded flanges 32 at which the flow-controlling walls 33 can be fixed. These flow-controlling walls 33 are made from polytetrafluoroethylene and goes from the outer vertical sides of the base plate 14 up to a height about 0.9 m below the upper edge of the partition walls 13. The outer flow-controlling walls 33 are provided with additional parts 34 of synthetic material for protecting the ends of the housing.

Each cell space in the shown construction holds about 1 $m^3$ of electrolyte. The whole housing is filled with electrolyte at operation and a potential is applied between the current connections 7. The hydrogen, which has lift, will then make the electrolyte circulate as previously described, i.e. up between the flow-controlling walls 33 and down between the long sides of the housing and the flow-controlling walls 33. At the highest flow point the electrolyte flow turns and a part of it is conveyed from the housing via the opening 8. The removed amount corresponds to a complete change of electrolyte each hour. The remaining electrolyte flows anew in between the electrode gaps in the cell package after having turned at the bottom of the housing.

Figure 1:
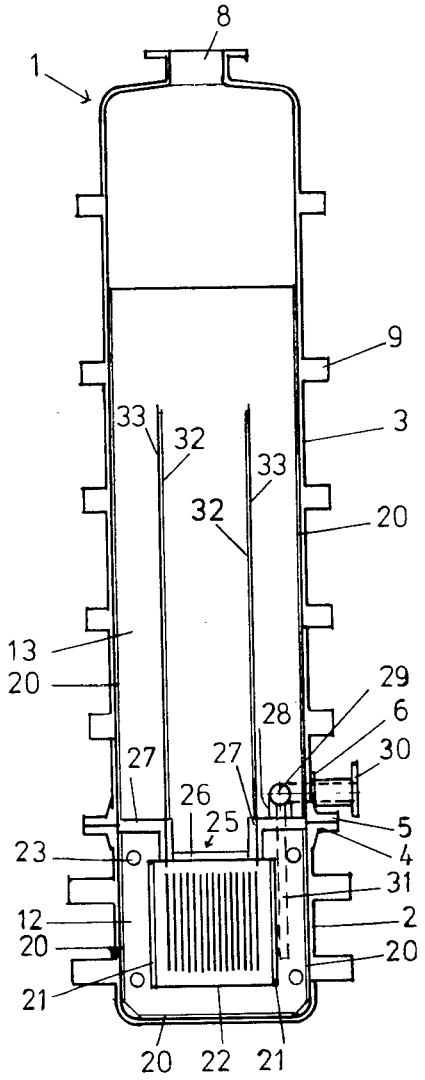
Figure 2:
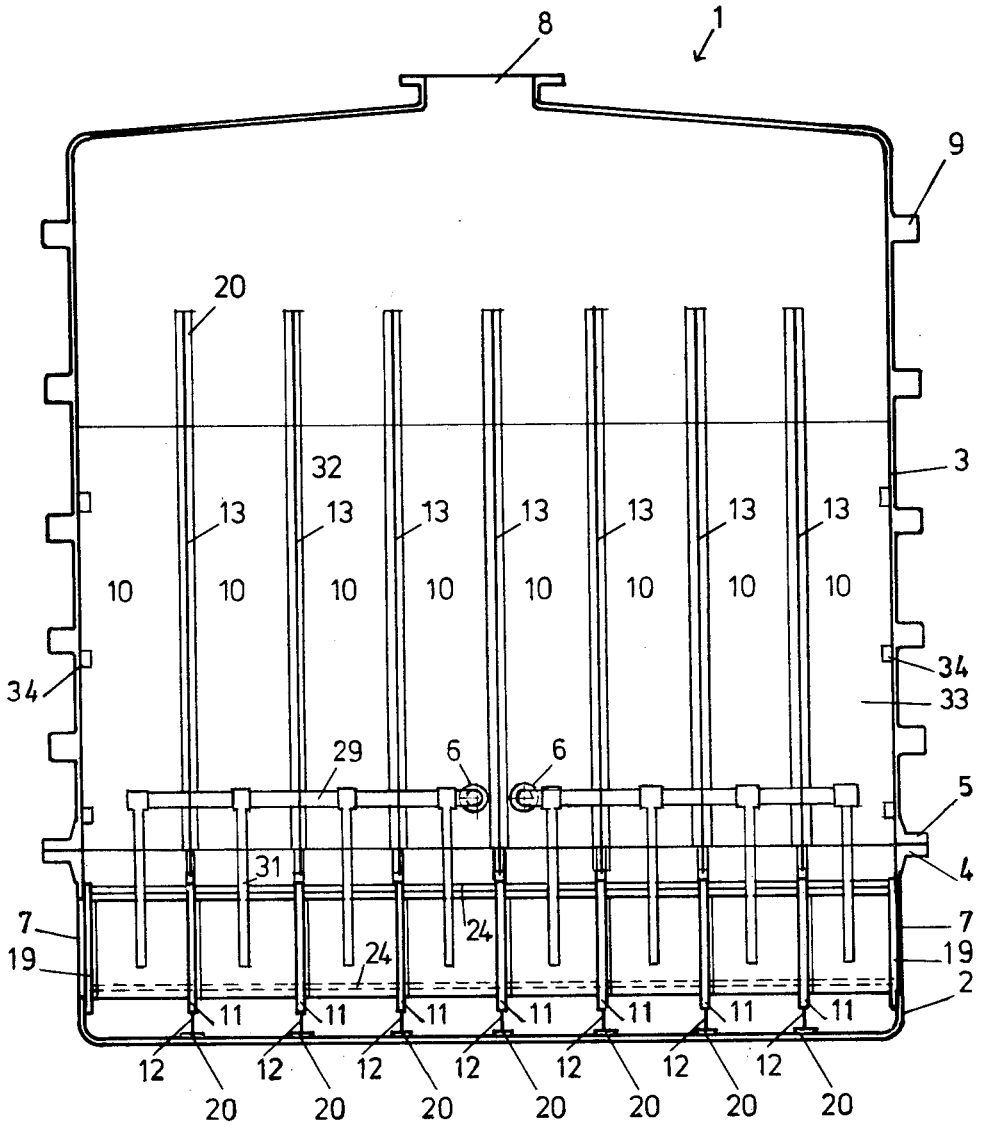
Figure 3:
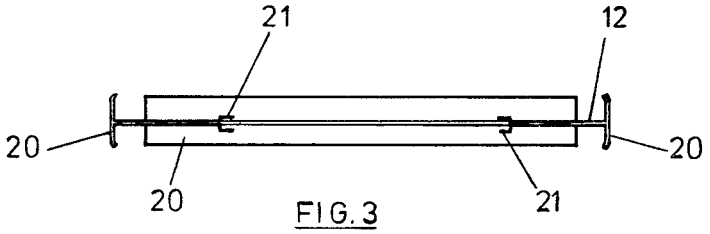
Figure 4:
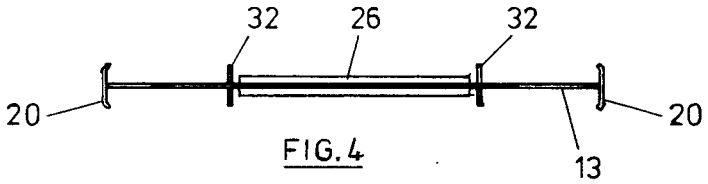
Figure 5:
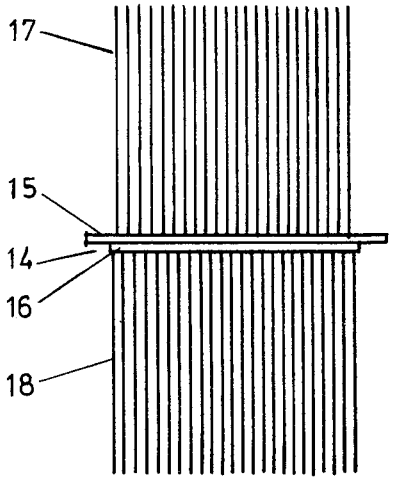

The invention is not limited to the shown embodiments but can vary within the scope of the appended claims.

I claim:

1. An electrolytic cell, including a cell housing with side walls, bottom and top, two terminal electrodes, each having a vertical base plate, one side of which having electrical connections and the other side of which being provided with a number of vertical electrode plates extending essentially at right angles to the base plate, said two terminal electrodes being arranged in the cell housing with their base plates parallel and with their electrode plates at right angles thereto, at least one bipolar electrode having a vertical base plate, both sides of which having a plurality of vertical electrode plates extending outwardly at essentially right angles to the base plate, each bipolar electrode being arranged in the cell housing between said terminal electrodes and with the base plates of each bipolar electrodes parallel with the base plates of the terminal electrodes, and being positioned in such a manner that the electrode plates of adjacent electrodes are interleaved between each other to form between the base plates a number of serially connected individual cell units, partition walls extending outwardly from the base plates of the bipolar electrodes in the same plate thereof in a sealing manner and extending to the bottom and sides of the housing as well as upwardly towards the top of the housing, whereby a free space is present between the bottom of the housing and the electrode plates, a free space is present at least between one of the sides of the housing and the electrode plates and a free space is present in the housing above the electrode plates, which latter space above is larger than said other free spaces and a plurality of spacers extending between the partition walls and being attached to the partition walls for fixation of the partition walls and the base plates in parallel arrangement and at a stable mutual distance.

2. An electrolytic cell according to claim 1 in which said partition walls vertically end at a distance spaced away from the top of the housing, thus forming a space for electrolyte common to all the cell units immediately below the top of the housing.

3. An electrolytic cell according to claim 1 or 2 in which at least one outlet for electrolyte and hydrogen gas is arranged near the top of the housing.

4. An electrolytic cell according to claim 3 in which said outlet goes to a gas separator with a conduit for the electrolyte to a chlorate separating step.

5. An electrolytic cell according to claim 1 wherein the housing has a height which permits an electrolyte level above the electrode plates of about 5 to 15 times the height of the electrode plates.

6. An electrolytic cell according to claim 1 wherein the material of the partition walls is titanium plate.

7. An electrolytic cell according to claim 1 wherein the housing is made of non-conducting synthetic material with an inner covering of flourine containing plastic.

8. An electrolytic call according to claim 1 in which the partition walls are divided into a lower portion and an upper portion along a dividing line adjacent the base plate.

9. An electrolytic cell according to claim 1 in which the edges of the partition walls which are in contact with the housing are provided with edge terminations which accomodate to the inner side of the housing.

10. An electrolytic cell according to claim 1 in which flow-controlling walls are arranged vertically and extending essentially parallel to the electrode plates in the upper portion of the housing so that a central space above the electrode plates is formed for rising electrolyte and also a space for electrolyte going downwards is formed along the sides of the housing parallel to the electrode plates.

* * * * *

UNITED STATES PATENT AND TRADEMARK OFFICE

CERTIFICATE OF CORRECTION

PATENT NO. : 4,326,941

DATED : April 27, 1982

INVENTOR(S) : WESTLUND

It is certified that error appears in the above—identified patent and that said Letters Patent is hereby corrected as shown below:

The Inventors Name under Line [19] on the cover page should be corrected to --- WESTLUND ---

Line [75] should read

[75] Inventor: STURE WESTLUND, Sundsvall, Sweden

Signed and Sealed this

*Thirty-first* Day of *August 1982*

[SEAL]

*Attest:*

GERALD J. MOSSINGHOFF

*Attesting Officer*

*Commissioner of Patents and Trademarks*